US005402730A

United States Patent [19]

Salter et al.

[11] Patent Number: 5,402,730

[45] Date of Patent: Apr. 4, 1995

[54] PLATEN DRIVE UNIT

[75] Inventors: Kenneth D. Salter, Los Angeles; Daniel A. Armstrong, Simi Valley, both of Calif.

[73] Assignee: The Walt Disney Company, Burbank, Calif.

[21] Appl. No.: 105,845

[22] Filed: Aug. 11, 1993

[51] Int. Cl.[6] ..... B61B 13/00

[52] U.S. Cl. ..... 104/168; 104/165

[58] Field of Search ..... 104/165, 163, 168, 170; 198/722, 782

[56] References Cited

U.S. PATENT DOCUMENTS

| | | | |
|---|---|---|---|
| 1,388,508 | 8/1921 | Brilhart . | |
| 1,656,301 | 1/1928 | Stevens . | |
| 3,039,402 | 6/1962 | Richardson | 104/168 |
| 3,249,065 | 5/1966 | Adams . | |
| 3,412,690 | 11/1968 | Broggie et al. . | |
| 3,530,800 | 12/1967 | Watkins . | |
| 3,559,335 | 2/1971 | See | 104/168 |
| 3,848,535 | 11/1974 | Mitchell | 104/168 |
| 3,880,088 | 4/1975 | Grant | 104/168 |
| 4,361,094 | 11/1982 | Schwarzkopf | 104/168 |
| 5,067,413 | 11/1991 | Kiuchi et al. | 104/168 |

FOREIGN PATENT DOCUMENTS

| | | | |
|---|---|---|---|
| 0249839 | 12/1987 | European Pat. Off. | 104/168 |
| 1370670 | 7/1964 | France | 104/168 |
| 1405537 | 1/1969 | Germany | 104/268 |
| 0252167 | 12/1987 | Germany | 104/168 |

*Primary Examiner*—Mark T. Le

*Attorney, Agent, or Firm*—Pretty, Schroeder, Brueggemann & Clark

[57] ABSTRACT

The preferred embodiment is a platen drive unit that propels the platens of vehicles moving along a track. The platen drive unit may be readily used at any portion of the track, since it acts as a castor about a kingpin assembly, thereby substantially reducing the effects of roller scrub in curved track portions. A self energizing structure balances a dual-pivot arrangement of frames, such that the drive roller of the unit is balanced to intersect the conveyance plane without imposing a "bump" or lurch upon a vehicle that first engages the drive roller. Additionally, the drive roller is preferably a dual-rate tire which features a compliant range, within which the tire is readily deformed, but which continues to drive the platen with a large normal force. Beyond the compliant range, the tire is not compliant to deformation. The dual-rate tire may be created by constricting the circumference and filling the deformed tire with a urethane filler, which is allowed to cure. The constricting influence is removed, and the tire tread punctured to allow air to fill an ullage between the filler and the tread, creating the compliant region.

20 Claims, 4 Drawing Sheets

7
13
11
15
25
35
39
41
43
45
47
51
53
57
61
73
77
79
81
83
85
87
89
91
99
101
103
105
107
109
111
113
115
119
123
125
127
129
131
133
135
137
139
141
143
147
149
151
154
155

PLATEN DRIVE UNIT

This invention relates to a platen drive unit that propels vehicles along a track. While it is relatively common for vehicles to have their own source of propulsion, platen drive systems feature a track-mounted source of propulsion that engages and propels a generally flat plate, or "platen," moanted by the vehicles. This invention presents a specific type of platen drive unit.

BACKGROUND

Platen drives have long been used in amusement parks and other environments where it is desirable to propel a vehicle along a track. A platen drive unit has two major components (1) a drive unit, which is positioned at or adjacent to the track, and which has a drive roller that frictionally engages and powers a passing vehicle, and (2) a platen, or flat, generally horizontal plate of the vehicle, that is mounted by the vehicle in a position to engage the drive roller and to receive therefrom propulsion sufficient for the vehicle to reach the next platen drive unit.

One well-known example of a platen drive system is the famous "PEOPLEMOVER" attraction, found at Disneyland Park® in Anaheim, Calif. In this attraction, a platen is positioned underneath each vehicle, in a horizontal plane. The underside of the platen is coated with a textured surface to increase friction. Thus, as the vehicle travels along a predefined path, the platen "runs over" individual drive rollers, and is powered thereby. Each platen drive unit is mounted at spaced intervals along the track, and the spacings of the intervals are configured such that the vehicle platen is always driven by at least one platen drive unit. This configuration enables a brake within each drive unit to freeze the vehicle, should an emergency condition occur on the track. Each drive unit typically has a high-voltage electric motor and gear reduction that slows down the motor speed to provide relatively slower, more powerful rotations of the drive roller to thereby propel each vehicle that passes the drive unit. Each platen drive unit can thus abstractly be described as a rotatably-mounted friction wheel which is driven by a gearmotor to propel a passing vehicle.

Platen drive schemes are frequently advantageous for propelling vehicles along a track, because each vehicle need not possess a drive unit, which imposes spatial constraints in vehicle design, requires a drive scheme that is more complex, increases vehicle weight, and requires a high voltage power supply to be placed in proximity to passengers riding the vehicle. Individual platen drive units along a track may be readily adjusted to provide different vehicle speeds at different positions of the track, without requiring a sophisticated control system or operator for each vehicle. In addition, the cost of running the attraction is fixed, and thus, additional vehicles may be added to the system without increasing operating costs. System maintenance is generally facilitated, since the platen drive units may be modularized, and easily replaced without requiring removal of the vehicle from service.

Also, platen drive systems are attractive from a speed-regulation standpoint, since if a platen approaches a drive unit at a speed which is less than the speed at which the drive roller is rotating, then the drive accelerates the vehicle. Conversely, if the platen is travelling faster than the roller rotation, then the drive brakes the vehicle speed.

In order to develop the friction needed to accelerate or brake the vehicle, a vertical contact force must be developed between the platen and the drive roller. This force is called the "normal force," and the manner in which the normal force is developed is of critical importance to the performance of a platen drive system. There are two basic schemes for developing the normal force which have been used in the prior art, including "fixed base" and "self energizing" schemes.

"Fixed base" drive units rely upon compression of the drive roller by the platen in order to develop the required normal force. These drive units use a friction wheel as the drive roller, such as a pneumatic tire, which is adjusted in its mounting until the top of the tire is substantially above the plane of the platen. Thus as the platen passes over the drive, the platen compresses the tire, thereby creating pressure against the platen and inducing a normal force. One particular advantage possessed by a fixed base drive unit is that it can provide both acceleration and braking force to vehicles of varying speeds that approach the drive unit. However, these drive units must also necessarily apply a greater magnitude of normal force than is necessary to propel the vehicles. This "stiffness" of the tire increases the bumpiness experienced by passengers of the vehicle.

A "self energizing" drive unit generally mounts the drive roller at the swinging end of a pivoting frame. This swinging end is held in position by a spring, such that the drive roller is forced to intersect a conveyance plane through which the platen of each vehicle will travel. The self energizing drives are particularly adapted to the fact that the platen of each vehicle will be mounted at a slightly different height. Consequently, the spring permits downward recoil of the swinging end of the frame upon engagement between the drive roller and the platen, and also ensures that the drive roller will engage the platen of each vehicle, provided that the spring is sufficiently stiff to position the drive roller against the platen. A related advantage is that the magnitude of the normal force applied to the platen is no larger than is absolutely necessary to develop the required friction force, thereby providing a smoother ride to vehicle passengers, relative to the fixed base drive units.

However, the known self energizing drives also have drawbacks. For example, any single drive can generally provide only one of acceleration or braking force. This drawback is occasioned by the drives' single, pivoting frame construction, wherein the drive roller can typically pivot away from a platen in only one direction. Very-stiff springs have been used in an attempt to provide both accelerating and braking force, although the stiffness of the springs detracts significantly from ride quality. In addition, while certain other spring-based self energizing drive units have been developed in an attempt to overcome this problem, for example, as shown in U.S. Pat. No. 3,530,800 to Watkins, additional problems are typically created by the use of a spring to directly bias the drive roller toward and through the conveyance plane.

For example, a drive roller is urged by these self energizing units (1) forcefully upward by a stiff spring, to maintain a high normal force with platens that engage with the roller, and thereby propel passing vehicles, and (2) toward and through the conveyance plane, to thereby contact the platens of each vehicle, which may have slightly varying heights within a defined tolerance with respect to the drive roller. As the platen contacts the drive unit, the top of the drive roller interferes with the plane of the platen, creating a bump or lurch felt by the passengers that is similar to that created by a fixed base drive. The interference ensures engagement as the spring presses the tire upward against the platen, but causes a sudden impact when the platen first engages the wheel. As a result, the ride quality of a spring-based self energizing drive is not much better than that of a fixed base drive.

Other types of self energizing platen drive units have been designed, in an attempt to overcome these problems, but are frequently too expensive. For example, drive rollers may be pneumatically or electromechanically actuated to engage a platen only at times when the platen is actually adjacent to the drive roller. However, the pneumatics or electromechanics that perform these functions require sensors and complicated control systems, which increase unit cost and maintenance requirements.

Another problem with the aforementioned drive units is the occurrence of excessive tire wear to drive units placed along curves in the track. This wear is caused by lateral movement of the platen relative to the drive unit as the vehicle turns while in continued engagement with the drive roller. As the vehicle moves through a curved portion of the track, the heading angle of the platen changes. When this heading angle is not aligned with the plane of rotation of the drive roller, "scrubbing" occurs, which causes excessive roller wear and energy consumption. In addition, undesired high lateral forces are applied to the motor and gearing that support the drive roller.

Thus, there exists a need for an improved platen drive unit that provides for adequate traction to propel vehicles, yet does not cause the vehicle to experience a strong "bump" or lurch as the drive unit engages the platen of the vehicle. In addition, there exists a need for a platen drive unit that provides adequate traction to propel vehicles, yet also is compliant for platens of various heights with respect to the drive roller and the general conveyance plane. Finally, a need exists for a platen drive unit that is compliant with lateral forces incurred by drive units positioned at curves. The combination of all of these features in a single platen drive unit would advantageously enable the use of a single drive unit, having a single footprint, to meet all drive unit needs, reducing inventory and maintenance requirements. The present invention satisfies these needs and provides further related advantages.

SUMMARY OF THE INVENTION

The present invention presents a platen drive unit that provides for a smoother ride, allows for a larger tolerance range of platen height, and significantly reduces the maintenance and inventory costs of a platen drive system. Using the principles of the invention, a platen drive unit may be implemented as both an accelerating and braking device, as well as a device that eliminates lateral loads above a predetermined minimum. Accordingly, the platen drive system provided by the present invention also improves vehicle safety and system efficiency by reducing the number of emergency stops, by trimming the speed of fast or slow vehicles to a more easily regulated level.

In accordance with one aspect of the invention, a platen drive unit includes a drive roller adapted to contact and drive a vehicle's platen, a swivel mounting that pivotally mounts the drive roller about a vertical axis, thereby permitting the drive roller's rotation about the vertical pivot axis to reduce "scrubbing" and other effects of substantial lateral forces imposed upon the drive unit by a turning vehicle, and a motor that is operatively coupled to the drive roller to provide the rotational impetus of the drive roller. More particularly, this platen drive unit acts as a castored drive, and tracks changes in vehicle direction much like the wheels of a shopping cart are rotated about a vertical axis to support lateral movement of the shopping cart.

In another aspect of the invention, a drive unit may be configured with a drive roller and motor, and in addition, a self energizing device that permits pivot of the drive roller in two pivotal directions away from the conveyance plane. This self energizing device includes a base frame and a lower frame, each having fore and aft ends, an upper frame and a spring that tensions the fore ends of the lower frame and base frame together, thereby also tensioning the aft ends of the upper frame and lower frame toward the conveyance plane. That is, rather than directly urging a drive roller stiffly upward to interfere with the motion of an approaching platen, the present invention provides a set of counterbalanced frames which allow the drive roller to pivot away from the conveyance plane without a high degree of stiffness.

In yet another aspect of the invention, the platen drive unit may be implemented as including a drive roller having a stiffness that varies in dependence upon the impact loading placed upon the drive roller by the platen. More particularly, the drive roller may be configured to be a dual-rate tire that is compliant for a limited amount of deformation by its engagement with the platen, and that becomes substantially non-compliant to greater deformation. This configuration enables the drive roller to engage platens traveling within a defined height tolerance above the conveyance plane without a resulting "bump," or lurch, which detracts from ride quality.

The present invention also presents a method of constructing the dual-rate tire referred to above. A constriction band is first applied about the circumference of the tread of the tire, and is tightened to thereby deform the middle of the tread of the tire inward, to make a "V"-shape. A filler is then placed inside the tire, using it as a mold, and is allowed to cure to a solid and resilient state. Finally, the constriction band is removed and the tread of the tire punctured to permit air to enter the tire. The tire is thereby relaxed to its normal shape, with a quantity of both air and resilient filler occupying the tire. By specifically tailoring the constriction of the tire, the compliant range and normal force applied by the tire may be adapted to most any particular environment.

The invention may be better understood by referring to the following detailed description, which should be read in conjunction with the accompanying drawings. The detailed description of a particular preferred embodiment, set out below to enable one to build and use one particular implementation of the invention, is not intended to limit the enumerated claims, but to serve as a particular example thereof.

BRIEF DESCRIPTION OF THE DRAWINGS

FIG. 8 is a graph that illustrates rotation of the preferred platen drive unit about a kingpin when lateral forces are imposed upon a drive roller of the platen drive unit.

DETAILED DESCRIPTION

Figure 1:
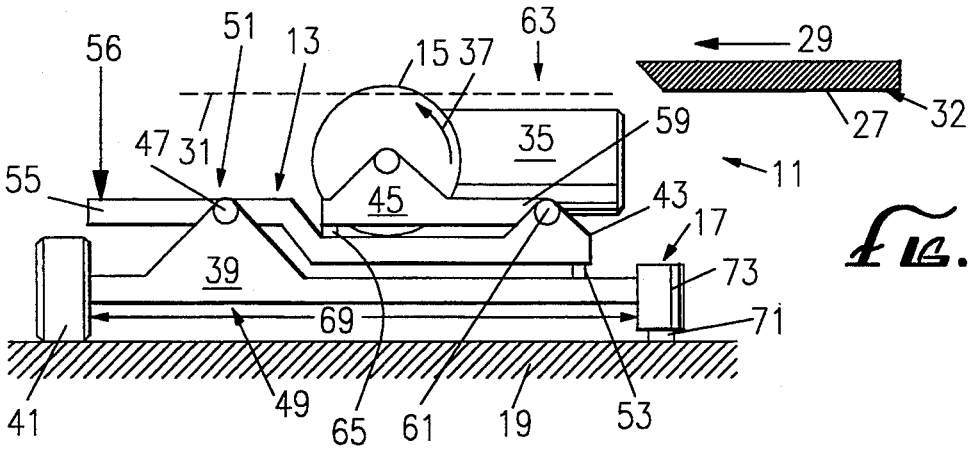
FIG. 1 is a simplified side view of the preferred platen drive unit of the current invention, illustrating the arrangement of the drive unit with respect to the platen of an oncoming vehicle.

The invention summarized above and defined by the enumerated claims may be better understood by referring to the following detailed description, which should be read in conjunction with the accompanying drawings. This detailed description of a particular preferred embodiment, set out below to enable one to build and use one particular implementation of the invention, is not intended to limit the enumerated claims, but to serve as a particular example thereof. The particular example set out below is the preferred specific implementation of each of the platen drive unit and the method of making a drive roller for a platen drive unit which were summarized above, and which are defined in the enumerated claims.

In accordance with the principles of the invention, the preferred implementation is a platen drive unit 11 that includes all of the specific aspects of the invention summarized above, and claimed below. In accordance with these various features, the platen drive unit 11 includes a balanced dual-pivot arrangement 13 of frames and a special drive roller 15 that combine to produce a smooth ride for a vehicle which approaches, and is driven by, the platen drive unit. In addition, the platen drive unit 11 is castored to pivot about a kingpin assembly 17, so that a single type of platen drive unit may be used throughout a track 19 that vehicles 21 will travel, including curved track portions 23. A centering device 25 is used to bias the special drive roller 15 to a preset orientation that is selected to correspond to the direction of travel of an approaching vehicle's platen 27 at the instant that it first engages the special drive roller. This description will first discuss the configuration of the preferred drive unit, followed by operating speed and resonance analysis, and finally, a discussion of the construction and configuration of a preferred dual-rate tire, used in the preferred platen drive unit 11.

The preferred platen drive unit 11 is shown as not including a locking device, which would be necessary to restrain the drive unit if operated to drive vehicles in the reverse direction. The preferred usage of the platen drive unit 11 is as a unidirectional device, that is, as a device that is used to propel vehicles in a single direction of travel, as indicated by the arrow 29, shown in FIGS. 1 and 2, and that applies both accelerating and braking force to vehicles 21 in order to regulate their speed. Since in the preferred embodiment, the kingpin assembly 17 is used as a vertical pivot axis for the drive roller 15 and is at the aft end of the drive unit 11, relative to the direction of travel 29, the platen drive unit need ordinarily not be confined in its range of swivelling motion. However, this configuration is unstable if the direction of travel is reversed, and a locking device necessary to restrain swivelling motion of the drive roller 15 and avoid resultant "scrubbing."

Construction And Operation Of The Preferred Drive Unit

With reference to FIG. 1, the platen drive unit 11 is shown as mounting the drive roller 15 in a vertical orientation to intersect a conveyance plane 31. A platen 27 of each approaching vehicle 21 is preferably mounted within a tolerance range, such that a no-stick surface 32 on the bottom of each platen will engage a dual-rate tire 33, within a compliant region. In the preferred embodiment, this no-stick surface 32 is preferably formed of a layer of "SAFETYWALK," general purpose grade, available from the Minnesota Mining & Manufacturing Company of St. Paul, Minn.

The dual-pivot arrangement 13 of frames rotatably supports the drive roller 15 and a motor 35, used to propel the drive roller in a direction of rotation that is designated by the reference numeral 37. These frames include a base frame 39, which is castored about the kingpin assembly 17 and also supported by a pair of castor wheels 41, and lower and upper frames 43 and 45 that provide the dual-pivot feature. The lower frame 43 is pivotally-coupled with the base frame 39 by a lower frame pivotal coupling 47 at the fore ends 49 and 51 of the base and lower frames, and includes a pair of lower frame stops 53 to impede excess clockwise rotation.

As seen in FIG. 1, the lower frame 43 extends beyond the lower frame pivotal coupling 47 in the fore direction and includes a distal end 55. The lower frame 43 is balanced about the pivotal coupling 47 by means of a biasing device that applies a downward force 56 upon the distal end 55 to balance the weight of the lower frame 43, drive roller 15, motor 35 and upper frame 45. In the preferred embodiment, as discussed further below, this biasing device includes a pair of balancing springs 57 (not shown in FIG. 1) that permit the lower frame 43 to rotate in the counterclockwise direction. The lower frame stops 53 limit clockwise rotation of the lower frame 43.

In this manner, at times when the drive roller 15 engages a platen 27 that is moving slower than the rotating surface of the drive roller, the drive roller will pivot in the counterclockwise direction about the upper frame pivotal coupling 61 while simultaneously applying an accelerating force to the platen.

The upper frame 45 mounts the drive roller 15, motor 35, and a right angle gear reduction (not shown in FIG. 1). In the preferred embodiment, the motor 35 is driven by a four-hundred and eighty volt, three-phase power supply, and supplies 1½ horsepower at seventeen hundred rotations-per-minute, and further, includes an electrically-operable motor brake, for arresting rotation of the drive roller 15 in emergency conditions. The gear reduction reduces the rate of rotation of the motor's shaft by a factor of thirty-five, to thereby drive the drive roller 15 at approximately fifty rotations-per-minute with enhanced torque. The upper frame 45 is mounted at its aft end 59 to an upper frame pivotal coupling 61. As seen in FIG. 1, the upper frame 45, including the drive roller 15, gear reduction 123 (not seen in FIG. 1) and motor 35 are counterbalanced about a center of gravity that is immediately adjacent to the upper frame pivotal coupling 61, as indicated by an arrow 63.

In this manner, at times when the drive roller 15 engages a platen 27 that is moving faster than the rotating surface of the drive roller, the drive roller will pivot in the clockwise direction about the lower frame pivotal coupling 41, while simultaneously applying a braking force to the platen. A pair of upper frame stops 65, not used under normal conditions, limit the amount of counterclockwise rotation of the upper frame 45.

The kingpin assembly 17 permits rotation of the drive unit 11 about a vertical pivot axis, such that the direction of rotation 37 of the drive roller 15 remains within a common vertical plane with the direction of travel 29 of the platen 27 at their point of contact, even when the vehicle is amidst a turn and the platen imposes lateral forces upon the drive roller. These lateral forces, once they exceed a predetermined threshold 67 (shown in FIG. 8), cause the centering device 25 to permit rotation of the drive roller 15 about the vertical axis to move with the lateral forces imposed by the platen, and to prevent "scrubbing."

Referring again to FIG. 1, the lateral forces cause the base frame 39 to rotate about the kingpin assembly 17, supported by the castor wheels 41 at a radial distance 69 from a kingpin spindle 71 of the kingpin assembly. The kingpin spindle 71 is anchored to the track 19 and pins a kingpin bearing assembly 73, thereby defining the vertical pivot axis, about which the base frame 39 rotates.

Figure 2:
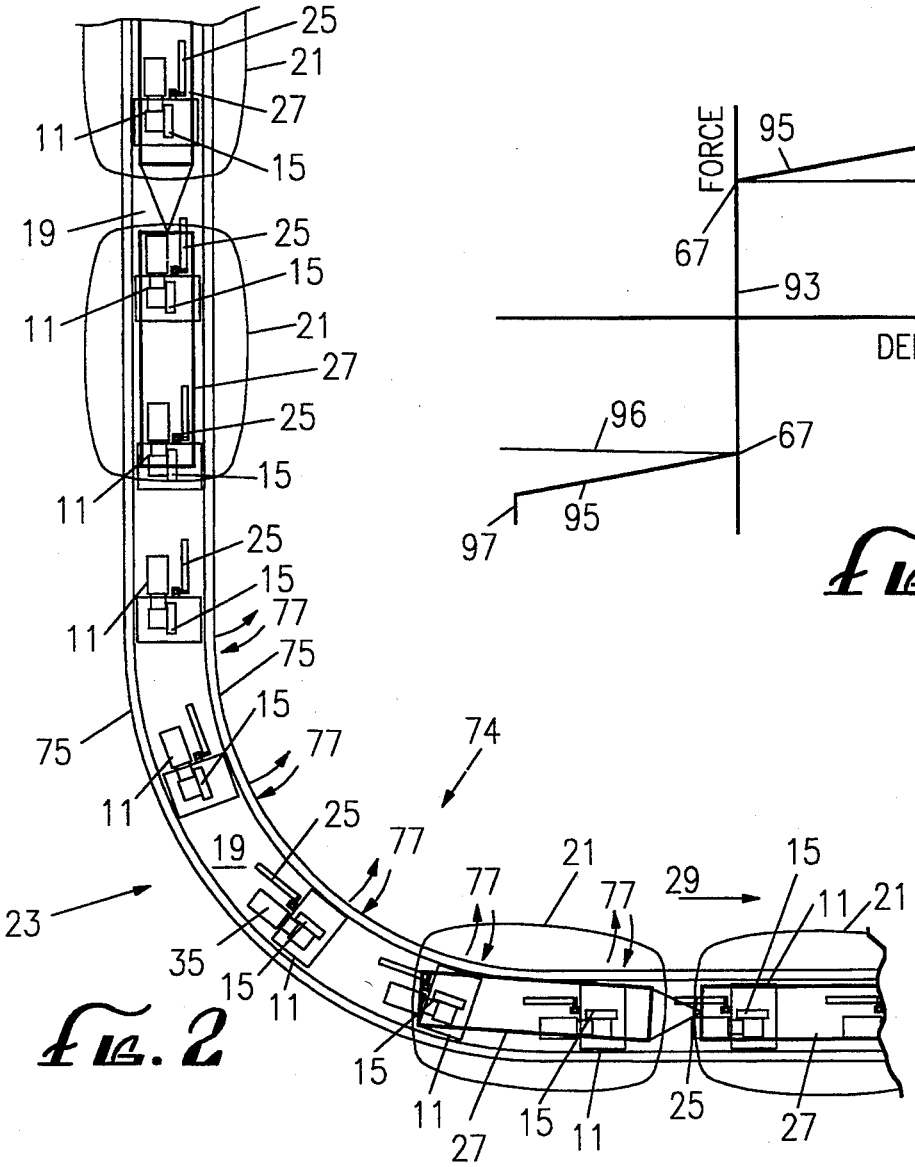
FIG. 2 is a plan view of a platen drive system, showing a number of vehicles that follow the rails of a track, and incorporating a plurality of drive units of FIG. 1 for continued vehicle propulsion along the track.

In FIG. 2, which is a plan view of a platen drive system 74, the placement of a plurality of platen drive units 11 may be observed in relation to the movement of a plurality of vehicles 21. The platen drive units 11 are each fitted between two parallel rails 75 upon which the vehicles 21 ride, and which form part of the track 19. As noted above, the fore end 49 of the base frame and of the platen drive units 11 is aligned with the forward direction of travel, as indicated by the arrow 29, and is opposite the kingpin assembly 17 about which each platen drive unit rotates. The rotation of the drive rollers 15 of the platen drive units 11 in the curved track portion 23 is illustrated by the motion arrows 77, and is centered to the positions shown in FIG. 2 by the centering device 25, as will be further explained below. Each platen 27 is represented in FIG. 2 as a rectangular, horizontally disposed plate that is mounted below the underside of each vehicle 21.

Figure 3:
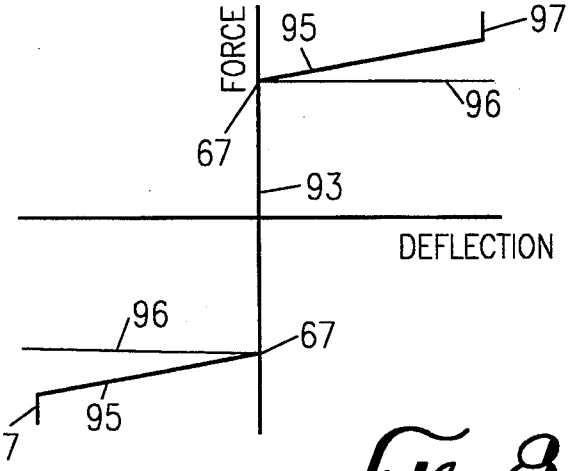
FIG. 3 is a detailed side view of the platen drive unit of the present invention.
Figure 4:
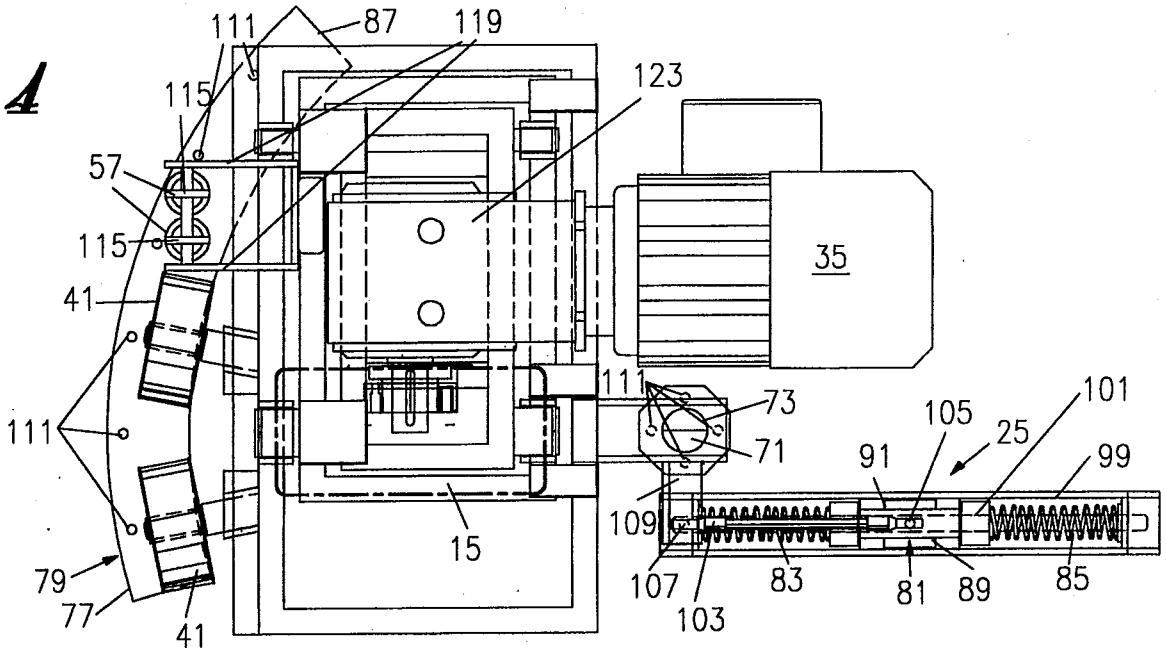
FIG. 4 is a plan view of the platen drive unit of FIG. 3.
Figure 3:
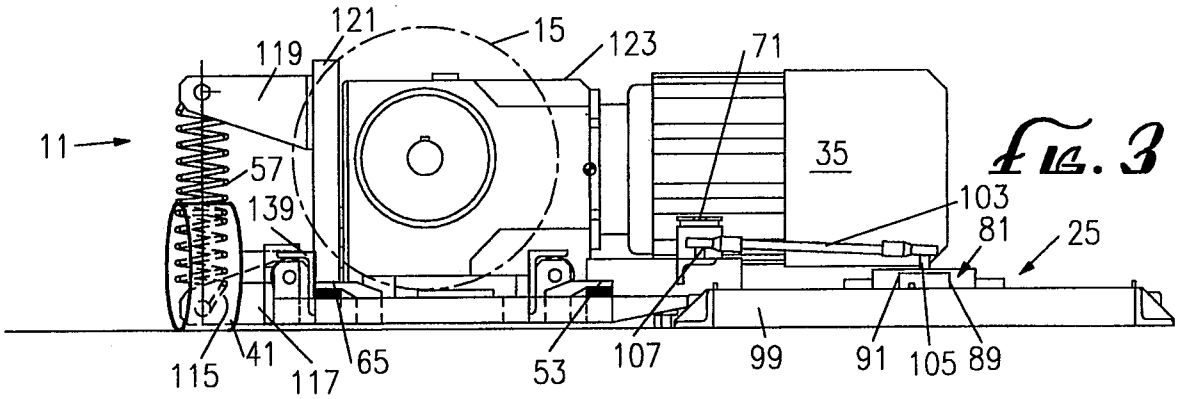
Figures 5, 6, 7:
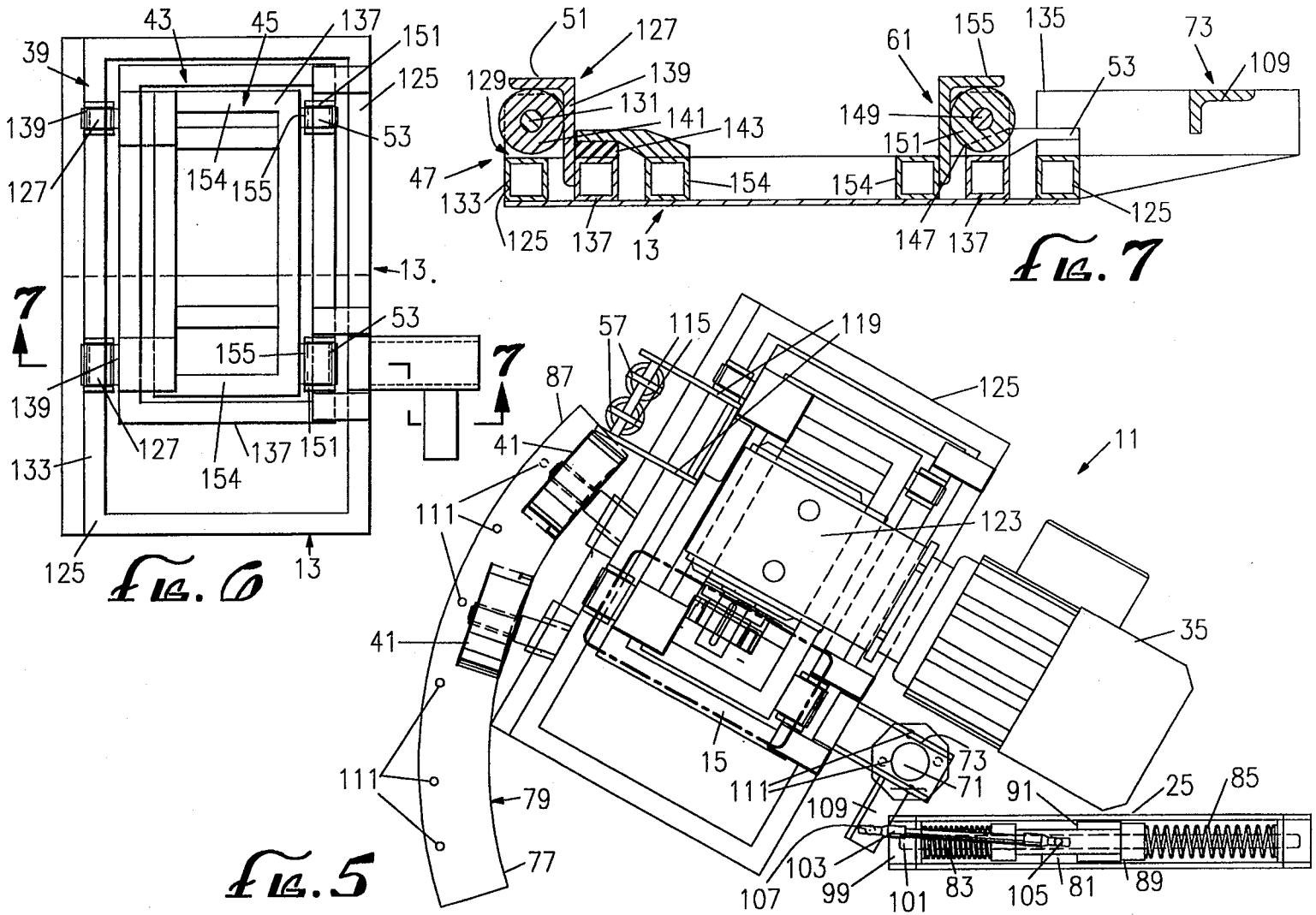
FIG. 5 is another plan view of the platen drive unit of FIG. 4, but illustrating the unit as pivoted about a vertical axis to accommodate a vehicle that is in the process of turning.
FIG. 6 is a simplified plan view of the platen drive unit of FIG. 4, showing only the dual-pivot, self energizing frame structure thereof.
FIG. 7 is an enlarged side view of the dual-pivot, self-energizing frame structure of the platen drive unit of FIG. 6.

With reference now to FIGS. 3–7, the swivelling and self energizing features of the preferred platen drive unit 11 will be described in more detail. It is first noted that platen drive units 11 which are located in curved track portions 23 are typically installed such that their drive rollers 15 are rotated about their corresponding kingpin assemblies 17 in only one rotational direction during engagement with a platen 27, and subsequently swung back to the centered position by the centering device 25. FIGS. 4 and 5 show this arrangement, with FIG. 4 showing a centered platen drive unit, with the castor wheels 41 at a first end 77 of an arc-shaped castor wheel-track 79, and a plunger 81 of the centering device 25 in a stable, centered position between two opposing, left and right centering springs 83 and 85. By contrast, FIG. 5 shows the platen drive unit 11 swivelled to an extreme position with the pair of castor wheels 41 rollably-supporting the base frame 39 at a second end 87 of the castor wheel-track 79. Notably, the plunger 81 of the centering device 25 is shown as compressing the left centering spring 83, with the right centering spring 85 remaining in a fully extended position against a right spring stop 89.

If the platen drive unit 11 were called upon to instead rotate about the kingpin spindle 71, while engaged with a passing platen 27, in the opposite, counterclockwise direction, then the castor wheel-track 79 would be mounted at a different position with respect to FIG. 4 to allow the two castor wheels 41 to rotate in the counterclockwise direction with respect to their orientation in that figure. Such movement would also pivot the drive unit 11 in the counterclockwise direction with respect to its orientation in FIG. 4, with the result that the right centering spring 85 of the centering device 25 would be compressed by the plunger device 79, and the left centering spring would remain fully extended against a left spring stop 91.

As mentioned, since the drive unit 11 is normally centered by the centering device 25 (as seen in FIG. 4), the plunger 79 will in normal use only compress one of its left and right centering springs 83 and 85, depending upon the orientation of the platen drive unit 11 with respect to oncoming vehicles. The symmetric relationship of the centering device 25 permits use of the preferred embodiment in any of several possible configurations, including at the flex point between two curves of opposite orientation, wherein the platen drive unit 11 would be rotated in both orientations while engaged with a passing platen 27.

FIG. 8 shows the force required to swivel the drive unit 11 about the kingpin spindle 71 against the influence of the centering device 25. The centering springs are preloaded to provide sufficient force to overcome rotational friction in the kingpin assembly to return the drive unit 11 to center. The stiffness of these springs is preferably as small as possible, and limited only by practical considerations of the springs' length.

If a lateral force exceeds the preload value for the corresponding one of the left and right centering springs 83 and 85, the drive unit 11 is rotated about the kingpin spindle 71 against the resistance of the particular spring. This movement is designated in FIG. 8 by the reference numeral 95. The reference numeral 96 designates the ideal force curve, where deflection without resistance occurs in response to lateral forces greater than the aforementioned thresholds. Once the centering springs have been fully compressed, the drive unit may no longer be rotated, as indicated by the reference numeral 97. In practice, the radial distance 69 of the drive unit is sufficiently great with respect to the sharpness of the curved track portions 23 that neither centering spring 83 or 85 will be fully compressed.

With reference to FIG. 3, it is seen that the centering device 25 also includes a channel 99 in which the left and right centering springs 83 and 85 are borne, a plunger rod 101 central to the channel, and a link arm 103 which is pivotally-connected to each of a lug 105 of the plunger and a lug 107 of the base frame 39. The base frame 39 actually mounts a lever arm 109 which extends perpendicularly therefrom adjacent to the kingpin spindle 71, as seen in FIG. 3, which thereby acts against one of the preloaded centering springs 83 and 85.

As seen in FIG. 5, the entire platen drive unit 11 is affixed to the track only by the kingpin spindle 71 and the castor wheel-track 79, each secured thereto by a plurality of bolts 111. Accordingly, the weight of the drive unit 11 is supported only by the kingpin spindle 71 and the castor wheels 41 for swivelling motion of the drive roller 15 about the vertical pivot axis, defined by the kingpin spindle 71.

As shown in FIGS. 3–5, the pair of balancing springs 57 tensions the distal end 55 of the lower frame 43 towards the base frame 39, to thereby balance the lower frame about the lower frame pivotal coupling 47. Each of the two balancing springs 57 is formed into hooks 115 at their opposing ends, for respective connection to the retention pins of base frame and lower frame retention brackets 117 and 119. The lower frame retention bracket 119 is mounted in an elevated relationship with respect to the upper and lower frames 43 and 45, and is connected to the lower frame 43 by a vertical post 121, which extends upwardly behind the drive roller 15, shown in phantom in FIG. 3. The precise type and nature of the balancing springs 57 may be readily selected by one of ordinary skill in the art to supply force to balance the lower frame 43 and its load of the upper frame 45 and drive elements, including the drive roller 15, gear reduction 123 and motor 35.

The dual-pivot arrangement 13, while visible in FIGS. 3–5, may be better seen in FIGS. 6 and 7 where the non-frame elements have been removed for purposes of clarity.

Each of the base frame 39, lower frame 43 and upper frame 45 is shaped as a rectangular frame of hollow, square steel bars, which are approximately two inches (5 centimeters) wide in cross-section. The outermost rectangular frame 125 is part of the base frame 39, and is coupled to the lower frame 43 by the lower frame pivotal coupling 47 at each of two lower frame hinges 127. The outermost rectangular frame 125 mounts two vertically disposed ears 129 as part of these hinges 127, which each carry a horizontally-disposed pin 131, which serves as the male member of hinges.

At an aft end 133 of the outermost rectangular frame 125, adjacent to the kingpin assembly 17, a pivot arm 135 is mounted to the outermost frame, which couples the base frame 39 to the kingpin assembly 17. The pivot arm 135 mounts the kingpin bearing assembly 73 to rotatably-receive the kingpin spindle 71 for pivoting motion therearound. In addition, at this position, the pivot arm 135 also mounts the aforementioned lever arm 109, by which the centering device 25 applies a centering torque to the base frame 39 and the drive elements.

The lower frame 43 consists primarily of a second rectangular frame 137, disposed to lie within the outermost rectangular frame 125, and is likewise constructed of steel bars. At the fore end 51 of the lower frame, two angle-bars 139 are welded to extend vertically upwards to coact with the pins 131 of the base frame 39, to complete the lower frame hinges 127. Each of these angle-bars 139 rigidly mounts a female member 141 within its closed, angled portion 141, which receives the pin 131 for pivotal motion of the lower frame 43 about the pivot axis defined by the pin.

Adjacent to the angle-bars 139, and mounted directly atop the fore end 51 of the lower frame, are two upper frame rests 143, which prevent excessive counterclockwise rotation of the upper frame 45, as will be described below. At the aft end 145 of the middle rectangular frame 137, the lower frame bears two upwardly-extending ears 147 of the upper frame pivotal coupling 61, which defines a second, horizontally-disposed pivot axis about which the drive roller 15 may recoil. As was the case for the pivotal coupling 47 between the base and lower frames 39 and 43, the two ears 147 mount horizontally disposed pins 149, which engage female members 151 of the upper frame for pivotal movement about the second, horizontally-disposed axis.

Immediately adjacent to the upwardly-extending ears 147 and disposed at the aft corners of the middle rectangular frame 137 are the two lower frame stops 53, which prevent excessive clockwise rotation of the lower frame 43 by interfering contact with the aft end of the outermost rectangular frame 133.

The upper frame 45, as seen in FIG. 7, includes an inner rectangular frame 154 that is pivotally coupled to the lower frame 43 by two angle-bars 155. These bars are welded to the female members 151, to form two aft hinge assemblies 157 that allow the upper frame to pivot about the second, horizontally-disposed pivot axis. In addition, the inner rectangular frame 154 mounts the drive roller 15, the gear reduction 123, and the motor 35 in a counterbalancing manner, such that the drive roller 15 is normally maintained in intersection with the conveyance plane 31. The upper frame stops 65 are normally maintained upon the upper frame rests 143 for clockwise pivotal movement with respect to the lower frame.

Thus, as explained with reference to FIG. 7, the lower frame 43 is normally balanced by the balancing springs 57 such that the lower frame may pivot about the lower frame coupling in the clockwise direction when the platen drive unit 11 provides accelerating force to a platen 27. When the platen drive unit 11 is called upon to apply braking force, and the dual-pivot arrangement 13 is urged thereby in the counterclockwise direction, the upper frame rest 143 prevents counterclockwise rotation of the upper frame 45 alone, and the lower frame 43 and upper frame together rotate in the clockwise direction about the lower frame pivot axis, to permit the drive roller 15 to recoil slightly upon interfering impact with the platen 27. When the platen drive unit 11 is called upon to apply accelerating force, the dual-pivot arrangement is urged in the clockwise direction, and the upper frame 45 pivots about the upper frame pivotal coupling 61.

Operating Speed And Resonance Analysis

As mentioned, the preferred embodiment of the present invention is castored, so that it swivels during engagement of the drive roller 15 with a platen 27, much like the swivelling motion observed in the wheel of a shopping cart. However, castored platen drive units 11 will resonate if the drive roller 15 is called upon to drive a platen 27 at high speed, again, much like a shopping cart wheel, if certain design criteria are not met.

When the drive roller 15 is in engagement with the platen 27, the drive roller acts as a damped one degree of freedom oscillator. Consequently, as the frequency of rotation of the drive roller 15 is increased to propel vehicles 21 to have more velocity, the resonant frequency of the unit is approached. The following equation gives the critical speed, $v_c$, which defines the point of peak resonance, $$v_c = \frac{1}{2} \cdot d \cdot \sqrt{\frac{c_\alpha \cdot r_1}{J_p + m \cdot (r_1)^2}} \quad (1)$$

where d=diameter of the drive roller 15;

$c_\alpha$=cornering stiffness of drive roller 15 on the platen, 27 in terms of lateral force per slip angle (radians);

$r_1$=castor offset (horizontal distance between kingpin spindle 71 and the point of engagement between the drive roller 1B and platen 27);

$J_p$=the polar moment of inertia of the platen drive unit 11 at the point of engagement); and m=the mass of the platen drive unit 11.

For a given set of parameters, there exists a value of the castor offset, $r_1$, which maximizes the critical speed, $v_c$. This value is given by the formula set forth below:

$$r_1 = \sqrt{\frac{J_p}{m}} \quad (2)$$

To avoid the effects of any resonance, the platen drive unit 11 and track 19 are best designed for any particular implementation such that the drive roller 15 is never called upon to exceed $\frac{1}{3} \cdot v_c$.

Construction And Configuration Of The Preferred Dual-Rate Tire

In order for the self energizing effect to initiate, it is necessary for the drive roller 15 to engage the platen 27. However, the height of the periphery of the drive roller 1B and the platen 27 will be subject to variations. These variations may be occasioned by differences in rail height, variations in the weight of the vehicle 21, tread wear of vehicle load wheels and of the drive roller 15, and whether the track is continuing uphill or downhill. Once these tolerances are budgeted, a maximum expected tolerance can be established between the drive roller 15 and the platen 27.

These required tolerances and resultant interference between the drive roller 15 and the platen 27 motivate the desirability of the dual-rate tire 33. The tire 33 is optimally configured to be soft for deflections corresponding to the maximum expected interference 157 between the drive roller 15 and the platen. For larger amounts of interference, the tire 33 is desirably stiff in order to react the large normal loads developed by the self energizing effect. Using this design, the impact loads at engagement will not exceed the normal load required to drive the vehicle.

The dual-rate tire 33 of the present invention is created by filling a pneumatic tire 159 with urethane foam 161, which expands to the tire's internal rim 163 and its sidewalls 165, and adheres thereto. Prior to this filling process, a "V"-shaped cross section of the tire tread 167 is created by deforming the tire. This deformation is created by strapping a narrow hose clamp around the circumference of the tire 33 and coating the inside 169 of the tire tread with a mold release. After the tire 33 is filled with the urethane foam 161, the hose clamp is removed and pin holes punctured through the tread to allow the tire tread to expand and air to enter the ullage 171, which expands to occupy the width of the tire at its tread. According to the present invention, the ullage 171 may be specifically tailored to any specific platen drive application by taking into account the desired tolerance range and selecting a tire of appropriate width, or deforming the tire to have a shape other than a "V"-shape during the filling step.

Figure 9:
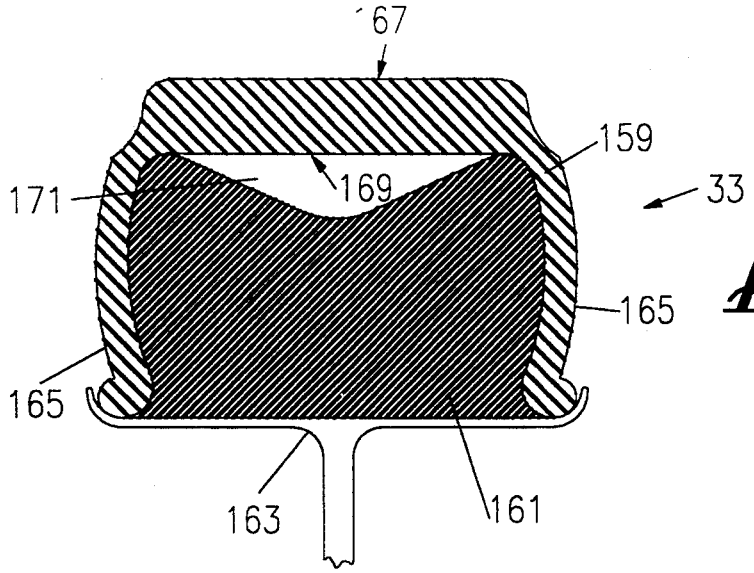
FIG. 9 is a cross-sectional view of a dual-rate tire used as the preferred drive roller of a platen drive unit.
Figure 10:
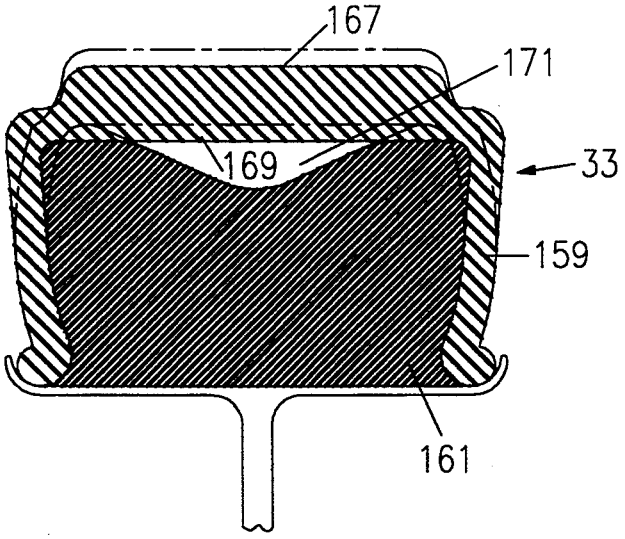
FIG. 10 is a cross-sectional view of the dual-rate tire of FIG. 9, with a small amount of compliant deformation of the dual-rate tire, from its engagement with a vehicle's platen. The cross-section of the undeformed tire of FIG. 9 is shown in phantom lines.
Figure 11:
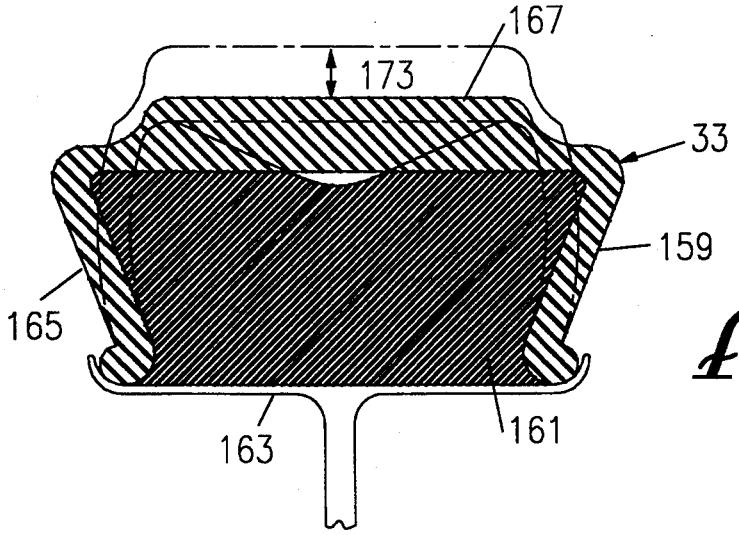
FIG. 11 is a cross-sectional view of the dual-rate tire of FIG. 9, with a deformation exceeding the compliant range of the dual-rate tire, from its engagement with a vehicle's platen. The cross-section of the undeformed tire of FIG. 9 is shown in phantom lines.

FIGS. 9–11 show the deformation of a dual-rate tire 33 according to the present invention. When not engaged with a platen, the tread 167 of the tire assumes a normal form, as illustrated in FIG. 9. When a platen engages the tread 167 of the tire within the compliant range 173, the tread of the tire is deformed by impact, yet continues to apply a normal force to the platen to propel the vehicle, as shown in FIG. 10. Air from the ullage 171 of the tire is forced out of the tire through the perforations in the tread 167, due to the pressurization in within the ullage 171 created by the engagement of the tread 167 with the platen. As seen in FIG. 11, the tire is resistant to deformation exceeding a predetermined amount, once the ullage 171 is fully compressed and the platen presses against the cured urethane.

The dual-rate tire 33 engages the undersurface of the platen for providing propelling impetus thereto and to assist in the generation of the normal force, even under wet conditions. As mentioned, this undersurface of the platen includes a no-stick material 32, which in the preferred embodiment has been selected to be a material known as "SAFETYWALK," general purpose grade, made by the Minnesota Mining & Manufacturing Company, of St. Paul, Minn. This material not only increases the friction between the platen 27 and the tire 33, but also substantially eliminates tire squeak caused by engagement between the two.

Notably, there are other ways of implementing a compliant region into the drive roller such as, for example, using two or more coaxial tires having different diameter and stiffness.

Having thus described several exemplary embodiments of the invention, it will be apparent that various alterations, modifications, and improvements will readily occur to those skilled in the art. Such alterations, modifications, and improvements, though not expressly described above, are nonetheless intended and implied to be within the spirit and scope of the invention. Accordingly, the foregoing discussion is intended to be illustrative only; the invention is limited and defined only by the following claims and equivalents thereto.

We claim:

1. A platen drive unit adapted to propel a platen of a vehicle along a conveyance plane, to thereby provide impetus to the vehicle for movement along a track, said platen drive unit mounted with respect to the track and comprising:

a drive roller adapted to contact the platen and provide the impetus to the platen, said drive roller intersecting the conveyance plane and having a rotational axis that is substantially parallel to the conveyance plane;

a swivel mounting that pivotally mounts said drive roller about a vertical axis that is substantially normal to said conveyance plane, thereby permitting the pivot of said rotational axis about said vertical pivot axis; and a motor operatively coupled to said drive roller to provide rotational impetus thereto.

2. A platen drive unit according to claim 1, wherein: said swivel mounting includes a base frame having a pivot end and a swinging end along a radial distance, a kingpin that defines said vertical pivot axis, and a castor wheel, wherein said base frame is horizontally disposed and has an underside where it is coupled to, and supported by, both of said kingpin at said pivot end, and said castor wheel at said swinging end, said base frame disposed to rotate about its coupling to said kingpin, said castor wheel disposed to turn in a vertical plane that is tangential to said radial distance;

said base frame supports said motor and said drive roller to thereby permit their pivot about said kingpin, said base frame supporting said drive roller so as to intersect the conveyance plane.

3. A platen drive unit according to claim 2, wherein said base frame includes a self energizing device that urges said drive roller toward said conveyance plane and into contact with the platen to thereby generate a normal force to the conveyance plane and a corresponding friction between said drive roller and said platen.

4. A platen drive unit according to claim 3, wherein said self-energizing device includes:

a lower frame;

an upper frame that is pivotally mounted to said lower frame to pivot about an upper frame horizontal pivot axis, said upper frame pivotally mounted to said lower frame at a first longitudinal end of said lower frame;

wherein said lower frame is pivotally mounted to said base frame to pivot about a lower frame horizontal pivot axis, said lower frame pivotally mounted to said base frame at a second longitudinal end of said lower frame opposite said first longitudinal end; and a resilient biasing device that permits recoil of said drive roller, away from the conveyance plane and toward said base frame upon contact with said platen, about said horizontal pivotal axes, and that urges said drive roller toward the conveyance plane;

wherein said drive roller is mounted by said upper frame.

5. A platen drive unit according to claim 4, wherein: said upper frame also mounts said motor; and said resilient biasing device includes a spring that couples said base frame with said lower frame, tensioning the two toward each other to thereby balance said lower frame at an inclination to said base frame and permit resilient downward pivot of said lower frame toward said base frame.

6. A platen drive unit according to claim 4, wherein said drive roller has stiffness that varies in dependence upon the impact loading placed upon said drive roller by impact between said drive roller and the platen.

7. A platen drive unit according to claim 6, wherein said drive roller includes a tire that is partially filled with a resilient filler to form a "V"-shape along the radial direction of said tire, about its circumference, the ullage of said "V"-shape expanding toward the tread of said tire, said tread permitting air to enter the ullage.

8. A platen drive unit according to claim 1, wherein said drive roller has stiffness that varies in dependence upon the impact loading placed upon said drive roller by impact between said drive roller and the platen.

9. A platen drive unit according to claim 8, wherein said drive roller includes a tire that is partially filled with a resilient filler to form a "V"-shape along the radial direction of said tire, about its circumference, the ullage of said "V"-shape expanding toward the tread of said tire, said tread having a perforated tread that permits air to enter the ullage.

10. A platen drive unit according to claim 1, further comprising a self energizing device that urges said drive roller toward said conveyance plane and into contact with the platen to thereby generate a normal force to the conveyance plane and a corresponding friction between said drive roller and said platen.

11. A platen drive unit according to claim 1, wherein:

said vertical pivot axis defines an aft end of said platen drive unit;

said platen drive unit includes a swinging end that pivots about said vertical pivot axis and that defines a fore end of said platen drive unit; and said platen drive unit further comprises a centering device that biases said fore end to be disposed, with respect to said aft end, generally in the forward direction of travel of the platen, and said rotational axis of said drive roller to be substantially perpendicular to the direction of travel of the platen at a point of first engagement between the platen and said drive roller, said swivel mounting permitting said rotational axis to rotate about said vertical pivot axis to track change in the direction of travel of the platen during the engagement between the platen and said drive roller.

12. A platen drive unit, comprising:

a drive roller that assists in propulsion of a platen of a vehicle, in a conveyance plane, for movement of the vehicle along a track, said drive roller mounted with respect to the track and having a region of compliance that permits said drive roller to be deformed upon engagement with said platen within a limited amount, and which provides substantial non-compliance for deformation exceeding said limited amount;

wherein said drive roller includes a tire that is partially filled with a resilient filler having a first resilience along the radial direction of said tire, toward its circumference, and with a second material having a second resilience, different from the first, filling the periphery of said tire between said resilient filler and a tread of said tire, the second material being air; and a self energizing device that urges said drive roller toward said conveyance plane and into contact with the platen to thereby generate a normal force to the conveyance plane and a corresponding friction between said drive roller and said platen.

13. A platen drive unit according to claim 12, wherein said tread is perforated to allow said air to escape upon engagement with the platen, and to allow air to fill said tire after engagement with the platen.

14. A platen drive unit according to claim 12, wherein:

said resilient filler forms a substantially "V"-shape along the radial direction of said tire, about a circumference of the tire, an ullage of the substantially "V"-shape expanding toward said tread with air filling said ullage;

said limited amount corresponds to a distance between the ullage of the substantially "V"-shape and the tread of the tire; and the substantially "V"-shape provides a changing ratio of amount of said first material to the amount of said second material at least along a portion of the radial direction of the tire, such that said tire provides an increasing degree of stiffness as deformation approaches said limited amount.

15. A platen drive unit comprising:

a drive roller that assists in propulsion of a platen of a vehicle, in a conveyance plane, for movement of the vehicle along a track, said drive roller mounted with respect to the track and having a region of compliance that permits said drive roller to be deformed upon engagement with said platen within a limited amount, and which provides substantial non-compliance for deformation exceeding said limited amount; and a self energizing device that urges said drive roller toward said conveyance plane and into contact with the platen to thereby generate a normal force to the conveyance plane and a corresponding friction between said drive roller and said platen, wherein said self energizing device permits recoil of said drive roller about two horizontal pivot axes away from the conveyance plane upon engagement between the platen and said drive roller.

16. A platen drive unit according to claim 15, wherein:

said self energizing device includes a base frame, a lower frame having a first horizontal pivot axis and a second horizontal pivot axis and coupled to said base frame at one of said horizontal pivot axes, and an upper frame coupled to said lower frame at the other of said horizontal pivot axes, said upper frame mounting said drive roller and said lower frame supporting both of said upper frame and said drive roller;

said drive roller is supported by said lower frame such that it has a center of gravity that falls substantially between said first horizontal pivot axis and said second horizontal pivot axis; and said drive roller is disposed to pivotally recoil away from the conveyance plane about said first horizontal pivot axis upon engagement with a platen that is moving relatively faster than the surface of the drive roller in the direction of travel, and about said second horizontal pivot axis upon engagements with a platen that is moving relatively slower than the surface of the drive roller in the direction of travel.

17. A platen drive unit according to claim 16, wherein said platen drive unit further comprises:

a motor, wherein said motor is also mounted by said upper frame, and wherein said upper frame mounts each of said drive roller and said motor in a manner such that said upper frame is balanced about the other of said horizontal axes at which said upper frame is coupled to said lower frame; and a spring that couples said upper frame to said base frame and is tensioned to balance said lower frame, said upper frame, said motor and said drive roller about the one of the horizontal pivot axes by which said lower frame is coupled to said base frame.

18. A platen drive unit comprising:

a drive roller that assists in propulsion of a platen of a vehicle, in a conveyance plane, for movement of the vehicle along a track, said drive roller mounted with respect to the track and having a stiffness that varies in dependence upon the impact loading placed upon said drive roller by impact between said drive roller and the platen;

a base frame that supports said drive roller to rotate about a rotational axis, said rotational axis substantially parallel to the conveyance plane; and a swivel mounting that pivotally mounts said base frame about a vertical pivot axis that is substantially normal to said conveyance plane, thereby permitting pivot of said rotational axis about said vertical pivot axis.

19. A platen drive unit adapted to propel a platen of a vehicle in a forward direction along a conveyance plane, to thereby provide impetus to the vehicle for movement along a track, said platen drive unit mounted with respect to the track and comprising:

a drive roller adapted to contact the platen and provide the impetus to the platen, said drive roller intersecting the conveyance plane and having a rotational axis that is substantially parallel to the conveyance plane;

a motor operatively coupled to said drive roller to provide rotational impetus thereto;

a self energizing device that permits pivot of said drive roller about two pivot axes away from the conveyance plane upon impact with the platen, said self energizing device including a base frame having fore and aft ends, a lower frame having fore and aft ends, said lower frame pivotally coupling to said base frame at their respective fore ends about a horizontal pivot axis for vertical pivoting motion with respect thereto, an upper frame having fore and aft ends that pivotally couples to said lower frame at their respective aft ends about a horizontal pivot axis for vertical pivoting motion with respect thereto, wherein said upper frame mounts said drive roller in intersection with the conveyance plane, and wherein said lower frame is further coupled to said base frame at their respective fore ends by a spring that tensions said fore end of said lower frame toward said fore end of said base frame, thereby also tensioning said aft ends of said upper frame and said lower frame toward the conveyance plane.

20. A platen drive unit according to claim 19, wherein:

said upper frame mounts said motor;

said platen drive unit further comprises a gear reduction that couples said motor and said drive roller to thereby pass motor torque to said drive roller; and said upper frame is balanced to have a center of gravity that is longitudinally between its aft and fore ends, and adjacent to its aft end.

* * * * *